US008177106B2

(12) United States Patent
Betts

(10) Patent No.: US 8,177,106 B2
(45) Date of Patent: May 15, 2012

(54) ADJUSTABLE GARMENT/COAT HANGER

(76) Inventor: John S. Betts, Woodstock, IL (US)

( * ) Notice: Subject to any disclaimer, the term of this patent is extended or adjusted under 35 U.S.C. 154(b) by 0 days.

(21) Appl. No.: 13/137,130

(22) Filed: Jul. 22, 2011

(65) Prior Publication Data

US 2012/0018462 A1 Jan. 26, 2012

Related U.S. Application Data

(60) Provisional application No. 61/344,435, filed on Jul. 22, 2010.

(51) Int. Cl.
*A41D 27/22* (2006.01)

(52) U.S. Cl. ..... 223/94

(58) Field of Classification Search ..... 223/85, 223/89, 90, 94, 88, 92
See application file for complete search history.

(56) References Cited

U.S. PATENT DOCUMENTS

| | | | | | |
|---|---|---|---|---|---|
| 1,040,942 | A | | 10/1912 | Hamilton | |
| 2,290,722 | A | * | 7/1942 | Weingarten | 223/94 |
| 2,436,314 | A | * | 2/1948 | Lesavoy | 223/89 |
| 2,653,739 | A | | 3/1951 | Zenk et al. | |
| 2,716,513 | A | | 8/1955 | Braunstein | |
| 2,728,499 | A | | 12/1955 | Mueller at al. | |
| 2,738,908 | A | * | 3/1956 | White | 223/89 |
| 3,858,770 | A | | 1/1975 | Murray | |
| 4,114,786 | A | * | 9/1978 | Wiese | 223/94 |
| 4,117,960 | A | * | 10/1978 | Bengsch et al. | 223/94 |
| 4,186,857 | A | | 2/1980 | Helms | |
| 4,673,115 | A | | 6/1987 | LaMont | |
| 4,730,757 | A | | 3/1988 | Keller | |
| 4,948,019 | A | | 8/1990 | Rodum | |
| 5,397,037 | A | | 3/1995 | Ozowa | |
| 5,979,721 | A | | 11/1999 | Curtis | |
| 7,237,702 | B2 | * | 7/2007 | Landis et al. | 223/89 |
| 7,694,859 | B1 | * | 4/2010 | Whittaker | 223/94 |
| 7,828,179 | B2 | * | 11/2010 | Sprovieri | 223/94 |
| 2007/0158374 | A1 | * | 7/2007 | Chan | 223/85 |
| 2010/0059557 | A1 | * | 3/2010 | Temali et al. | 223/94 |

* cited by examiner

*Primary Examiner* — Nathan Durham
(74) *Attorney, Agent, or Firm* — Donald Grant Kelly

(57) ABSTRACT

An adjustable garment hanger including an overhead suspension element and a pair of hanger arms extending outwardly from a central housing. Arm inclination is adjustable relative to fabric being supported so as to minimize wrinkling deformation. Arms may collapse immediately downwardly on pivots to a generally vertical mode releasing the garment via its neckline opening. A central, flexible spring element includes ledges latching arms in a first, garment supporting position. When the spring element is driven upwardly or downwardly by twisting the suspension element in a mutually threaded boss, the ledges slightly adjust the arms upward or downward. Quick release tabs may be provided at an upper end of the spring element such that, when manually pressed, the ledges instantly withdraw allowing the arms to collapse and release the garment. With garment weight removed, springs attached to the arms act to bias their return to garment supporting position each collapse.

6 Claims, 6 Drawing Sheets

ADJUSTABLE GARMENT/COAT HANGER

CROSS-REFERENCE TO RELATED APPLICATION

All priority benefits are hereby claimed under 35 USC 119(e) of prior-filed Provisional Patent Application Ser. No. 61/344,435 filed Jul. 22, 2010, said provisional patent application in its entirety being incorporated herein by reference thereto and for all purposes, as if fully set forth herein.

STATEMENT REGARDING FEDERALLY SPONSORED RESEARCH OR DEVELOPMENT

Not applicable

REFERENCE TO SEQUENCE LISTING

Not applicable

BACKGROUND OF THE INVENTION

1. Field of the Invention

The present invention relates generally to clothing hangers for coats, shirts, jackets and the like, and more specifically to hangers that are adjustable or readily collapsible and foldable to facilitate mounting clothing on the hangers or easily removing clothing therefrom.

2. Description of Related Art

Coat hangers are widely used throughout the world for temporary or long term storing of clothing items of all kinds. Indeed, many historians credit President Thomas Jefferson as inventor of a forerunner of wooden clothes hangers. Still today, the ubiquitous hanger configuration typically includes wire, wood or plastic looped into a generally triangular shape, with the looped portion terminating in an upwardly projecting hook suitably bent or otherwise fabricated to extend over a stationary hanging rod or rail usually tucked within a closet or wardrobe cabinet. A horizontal run or traverse of wire, plastic or wood element interconnects laterally extended clothing support arms or wings.

A great number of hanger variations have emerged over the years, most of which include special projection hooks, bottom traverse elements in the form of rods with or without trouser clips, and variously padded wings or support arms.

Generally speaking, the vast majority of hangers are alike, particularly with respect to the intersection angle included where the garment support arms or wings slope downwardly from a suspension point (generally a hook) thereabove. Regardless of hanger size, the suspension hook and wing slope, pitch or inclination usually are virtually identical throughout the industry. Some innovative attempts have been undertaken to offer more variation or broader accommodation for differing types of clothing or various shapes and sizes, as will be discussed below. However, these obviously have fallen short in terms of customer preference and have not been commercially successful.

Zenk received Patent grant U.S. Pat. No. 2,653,739 for an early version of collapsible hangers wherein a concealed spring normally urges hanger arms into clothing support mode (outstretched), and a latch secures that condition. LaMont received U.S. Pat. No. 4,673,115 for collapsible coat hanger formed entirely of molded polypropylene. The hanger includes a hook supported by a body member having right and left hanger arms attached thereto by living hinges. Collapsing the hanger to folded mode is done by manual pressure on the arms. Manually pressure is required to return it to operational mode where the living hinges snap into position to stabilize arm extension.

Braunstein's U.S. Pat. No. 2,716,513 describes a collapsible hanger requiring the user's to grasp the arms and provide manual pressure such that resilient nubs are forcefully released from resilient sidewalls; then to place the hanger in un-collapsed mode the nubs are returned by force to their previous position between resilient walls. Hamilton's U.S. Pat. No. 1,040,942 discloses a collapsible coat-hanger where the hook stem serves to latch the arms in operative position. When the stem is manually shifted the hanger can be manually folded for storage.

Helms received U.S. Pat. No. 4,186,857 for a coat hanger with first and second arms and a hook mutually pivoted on a pin so as to rotate relative to one another for manual folding from a use configuration to a storage configuration. The pivot pin engages one of the arms through a slot extending in the arm permitting the arm to slide relative to the pin to engage a projection on the arm with an abutment on the other arm, thereby holding the coat hanger in its open configuration. In U.S. Pat. No. 3,858,770, Murray describes a hanger with folding arms locked in place by a manually moved ball on a lower end of a hook. The ball engages concave areas of the arms for locking engagement with the ball.

U.S. Pat. No. 5,979,721A granted to Curtis shows a garment hanger having downwardly foldable, pivoted arms wherein a spring between the pivoted arms is compressed when the pivoted arms are in an operative position and a preferably slidable switch latch controls off-axis movement of a central portion of the spring to positively control movement of the pivoted arms between an operative position and a folded position and vice-versa.

Keller's collapsible clothes hanger illustrated and described in U.S. Pat. No. 4,730,757 employs a resilient band to bias the arms in outstretched position. Manual pressure forces the arms to collapse. In U.S. Pat. No. 2,728,499 issued to Mueller et al. describes a collapsible hanger where the "legs" are manually pressed together overcoming bias of a bow spring.

Rodum received U.S. Pat. No. 4,948,019 for a collapsible clothes hanger. The Rodum hanger includes a swivel hook mounted on a central hub. Hanger arms are spring-coupled to an extension of the hub. Rodum's arms may be manually pivoted to a folded position and latched with interlocking elements. Unlatching requires manual twisting of the hub. Springs then return the arms to an open (outstretched) position where they are manually fixed in operating position by central latching elements.

The Ozowa U.S. Pat. No. 5,397,037 features an inner compression spring maintaining pins (or short shaft elements) into recesses thus locking hanger arms in a general horizontal mode. Downward manual pressure on the hanger hook shaft overcomes spring force and causes the shaft elements to move into an arcuate pathway permitting the arms to swing downwardly.

The relatively complex Ozowa construct and the hanger apparatuses detailed in others of the above-noted patent documents reveal hangers with collapsible arm features, but require two hands for operation and/or necessitate a significant plurality of intricate and close fitting interacting parts. Increased structural complexity correspondingly increases manufacturing investment and invites opportunity for malfunction.

By way of contrast, the present invention is extraordinarily elegant and simple in form and sturdy in construction. Manufacturing and assembling a commercial version with a minimal number of parts can clearly be done at reasonable cost. The Consumer operation of the unique hanger will require no since its manipulation is intuitive from it visible elements. It requires a minimum of parts to accomplish dual functions, namely: 1. simple, progressive arm slope adjustment (to meet unique requirements of each garment; 2. rapid, one-hand activated arm-drop for instant separation from a garment supported thereon. This invention springs into action when its package is opened.

BRIEF SUMMARY OF THE INVENTION

The present invention is intended to fill a growing gap between consumer demand and commercial availability. Uniquely, the present invention presents multiple embodiments delivering dual mechanical features that can be deployed and utilized individually or collectively, as will become apparent from the detailed description that follows.

Basic features of a first invention embodiment include construction that affords users the ability to instantly and conveniently establish (or re-establish) the pitch or angle of hanger arms so as to better conform and uniformly support an article of clothing placed thereon. Fine adjustments are accomplished by a mere twist of a hanger hook, clockwise or counterclockwise depending on the direction of adjustment desired, up or down. The hook is threaded to the base of a spring element positioned within a housing generally surrounding the interconnection of the hanger arms.

A second embodiment of the present invention further users the ability to collapse the hanger arms through single-handed manipulation of a set of release tabs, also associated with the spring body element. When said tabs are depressed and pivot against the spring body, the hanger arms are immediately released to move downwardly so as to enable the hung article of clothing to slide or fall from the hanger. This is because the collapsed arms relatively pass through the clothing neckline or collar opening. Once the weight of the clothing item is alleviated from the hanger arms, the arms automatically return to their initial (or most recently re-established) position. The features of both first and second embodiments may be delivered in a single hanger design.

The unique invention will, of course, be more thoroughly understood with reference to a number of illustrations incorporated into the present application. These are introduced as follows.

Figure 1:
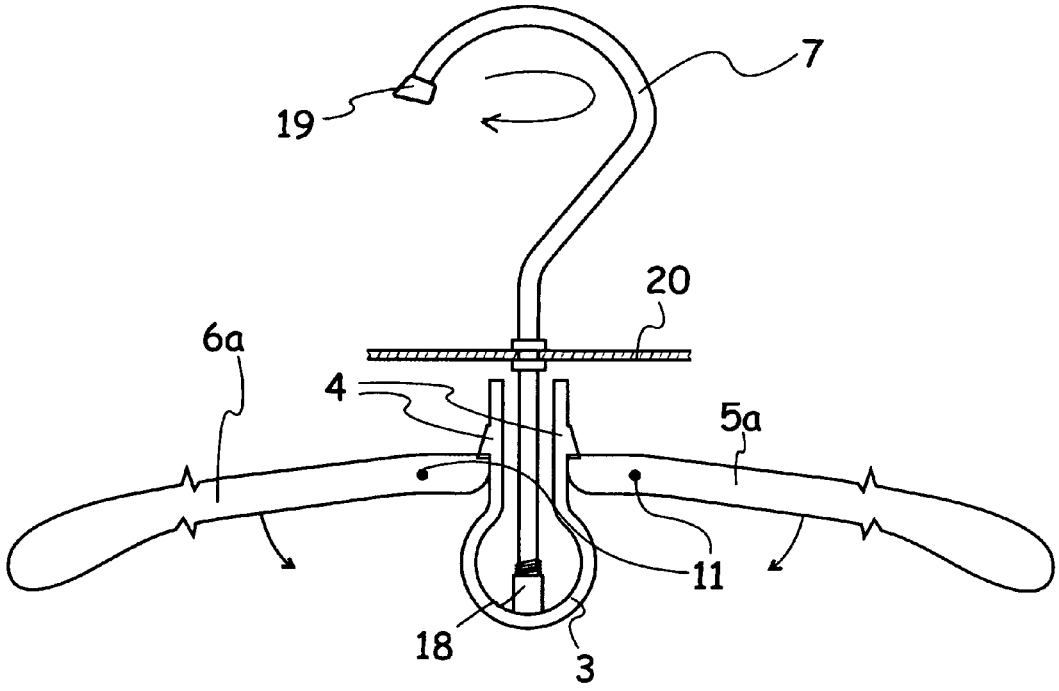
FIG. 1 is a partial front elevation of a first hanger embodiment of the present invention in an initial position.
Figure 2:
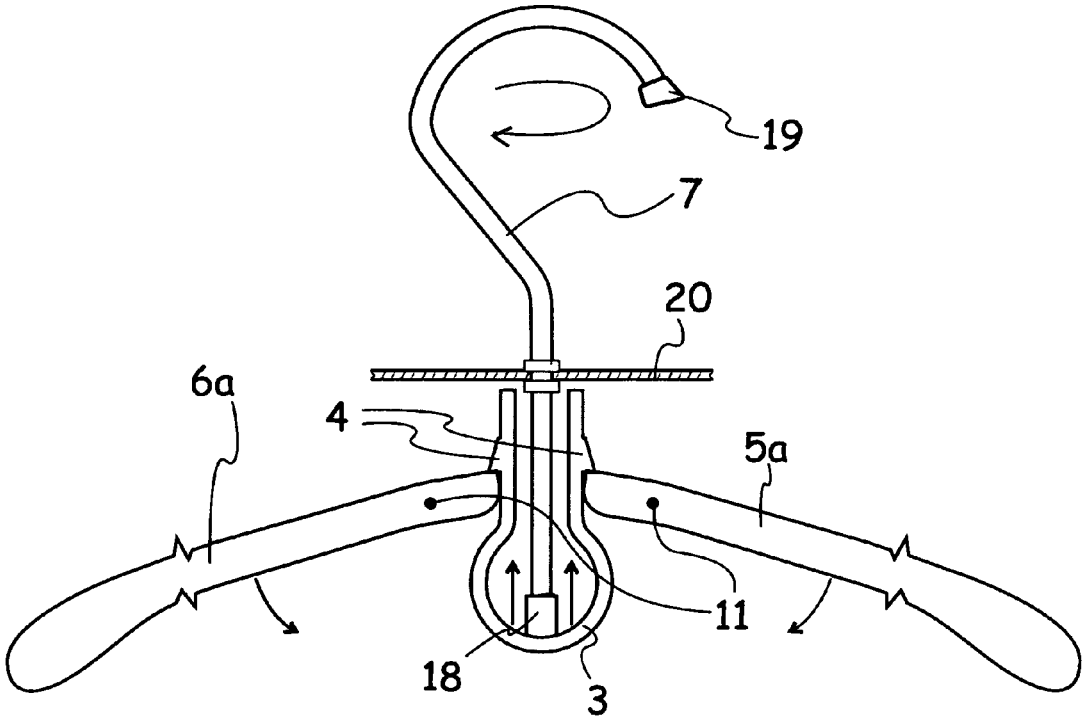
FIG. 2 is a partial front elevation of the same hanger embodiment of FIG. 1, but with its hanger hook moved to a second position.

With respect to the drawing figures just described, it is important to note that while the drawings are generated generally to scale, relative dimensions depicted are not to be considered as limiting (in any respect) the range of configurations that naturally and rightfully will fall under the scope of the present invention as defined by claims appended hereto.

DETAILED DESCRIPTION OF THE INVENTION

With reference to the invention embodiments shown in FIGS. 1-6, the following operative description references correspondingly numbered elements which make up the novel assembly. Beginning with the embodiment depicted in FIG. 1 and FIG. 2, the unique garment hanger of the present invention features first and second garment support arms 5*a*, 6*a* extending outwardly from adjacent inner ends to outer ends thereof. Inner ends of said arms 5*a*, 6*a* extend into a generally central housing 20 (viewed only partially in FIGS. 1 and 2 but more fully depicted in FIGS. 5 and 6).

Each of said arms 5*a*, 6*a* is respectively pivoted to said housing 20 at one of a first set of pivot pins 11 secured therein. Pivoting capability enables arms 5*a*, 6*a* to swing from a first outwardly extended garment holding position to a second downwardly collapsed (generally vertical) position resulting in garment release. Inclination of arms 5*a*, 6*a* may be incrementally modified (increased or decreased) within their generally horizontal position by means, and for purposes, explained herebelow.

A generally central hanger suspension element 7 includes a first end configured for interconnection to an overhead suspension structure. As an example, element 7 presents a well known hook profile for mounting on a typical closet rod and terminating with a padded tip 19 to avoid accidental scrapes to furniture, walls and such, or snagging garment fabrics. Of course, an optional design could substitute an upper terminal knob in place of the hook portion of suspension element 7. Said knob or detent (not shown) would be sized for fitting into a hanger suspension slot (not shown) of the type typically found in hotels.

Located in housing 20 and positioned between adjacent inner ends of arms 5*a*, 6*a* is a flexible spring body 3. Included within spring body 3 is a boss 18 threadably interconnected to said stem 7 at a lower end thereof. Spring body 3 is further provided with a pair of latching tabs 4 each of which extends outwardly therefrom respectively toward the inner ends of arms 5*a*, 6*a*. Each latching tab 4 on spring body 3 is further configured to include generally downwardly facing ledges respectively engaging an upper surface of inner ends of arms 5*a*, 6*a*. Direct engagement by latching tab 4 ledges maintains said arms 5*a*, 6*a* in their first outwardly extended garment supporting position.

When hook 7 is turned or twisted (see arrow indicator in FIGS. 1, 2), threads at the base of the stem of hook 7 (which threads interconnect with threaded boss 18 at the base of spring body 3) act to drive spring body 3 upwardly or downwardly within the assembly. As spring body 3 moves, tabs 4 on spring body 3 naturally move, as well. This permits incremental adjustment of the slope or incline of the hanger arms 5*a*, 6*a*.

Incremental adjustment of the arm incline can be important in matching or at least conforming to clothing fabric configuration supported thereby. For example, when a typical hanger arm is structurally limited to a fixed inclination, and that fixed inclination differs from the supported shoulder structure (say, a starched dress shirt), the result will be unwelcome creases or puckers in the fabric. Too often, garments abused in this manner must be ironed prior to wearing. A woven material may, in fact, be permanently deformed by a miss-matched hanger arm slope.

Continued turning or twisting of hook 7 can result in tabs 4 on spring body 3 being pushed upwardly (along directional arrows depicted in FIG. 2 within spring body 3) to an extent where the arms are clear of tabs 4. In this case, the arms will swing downwardly, turning on pivot points 11, to release the garment. This permits the garment neckline to pass relatively over the collapsed hanger arms. This is a positive result in that hanger removal (from the garment) is often difficult. Another feature of the present invention is shown in a second, modified embodiment wherein the hanger need not have its hook 7 withdrawn from hanging mode as is the case with the first embodiment. The second, modified embodiment will now be described in detail.

Figure 3:
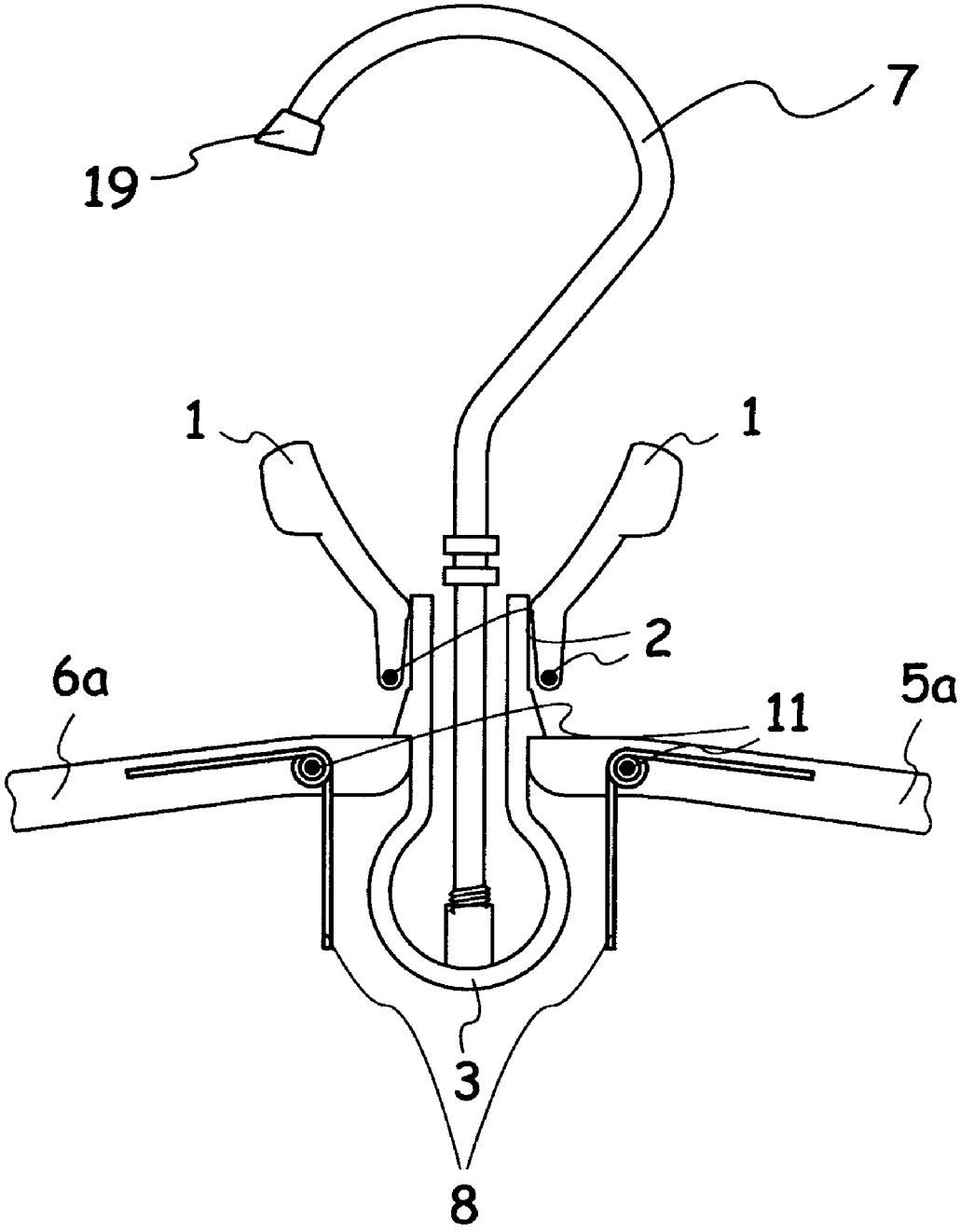
FIG. 3 is a partial front elevation of a second hanger embodiment of the present invention with spring body depressing tabs and hanger arms in an operative (extended) position.
Figure 4:
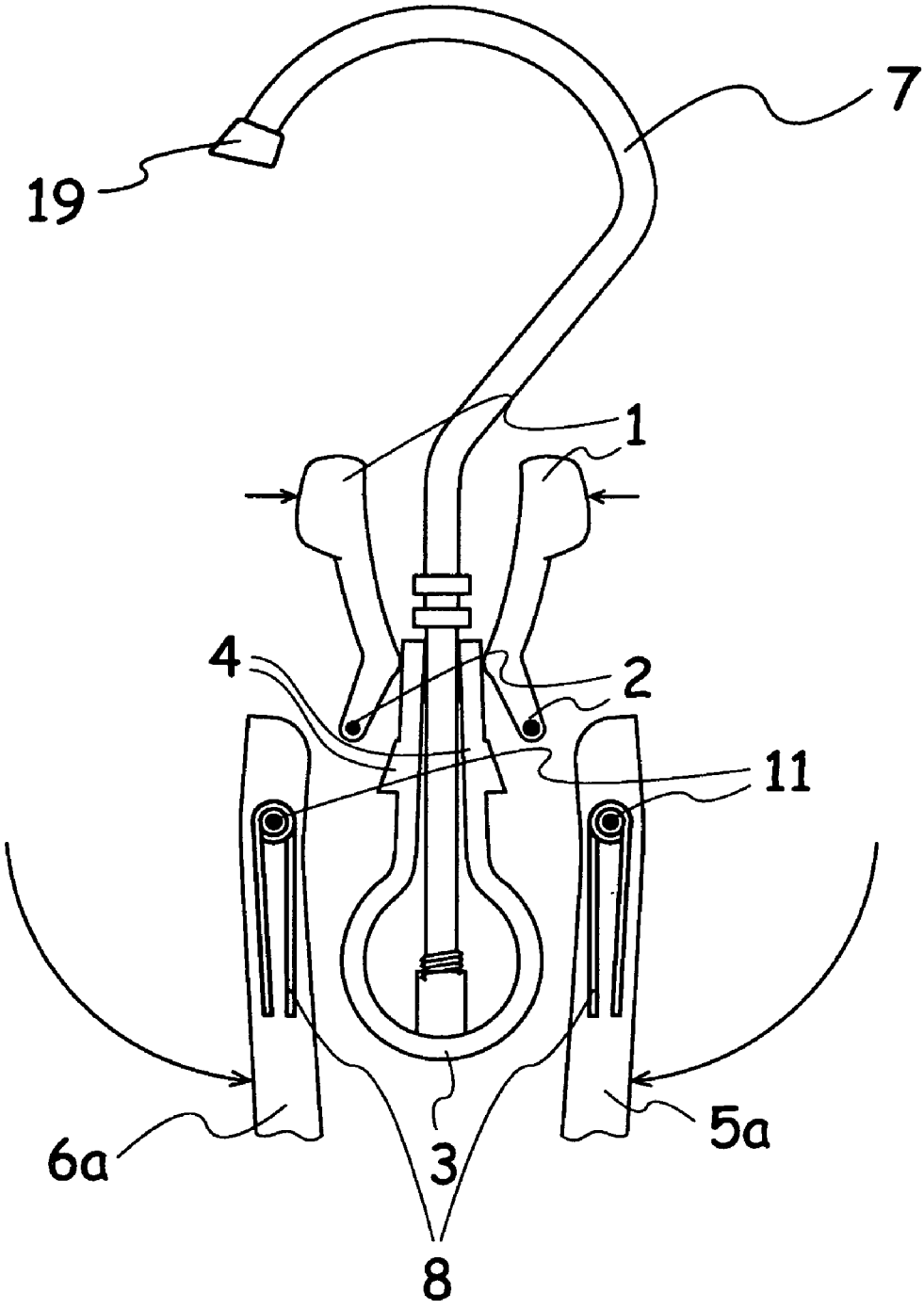
FIG. 4 is a partial front elevation of the hanger embodiment of FIG. 3 with tabs in activated spring body pressed position resulting in arms depicted in a drop or collapsed position.

With reference to FIGS. 3 and 4 an embodiment of the present invention is shown as including a second pair of pivot pins secured to housing 20 immediately above latching tabs 4 on opposite sides of spring body 3 adjacent respectively facing inner ends of arms 5*a*, 6*a*. A lever 1 is pivotally mounted on each of said second pair of pins, and configured to include a fulcrum portion thereof engaging said opposite sides of spring body 3. Arms 5*a*, 6*a* are depicted initially abutting lower ledges of latching tabs 4 in spring body 3 similar to FIG. 1. However, in this alternative embodiment, a return spring elements 8 is respectively pivoted on each of said second pair of pivot pins 2. Spring elements 8 act to return arms 5*a*, 6*a* to their first position following their movement to their second (collapsed) position.

Thus, in operation, when it is desirable to immediately release arms 5*a*, 6*a* release levers 1 are jointly pressed inwardly toward one another by the user's fingers. Levers 1 rotate about pivots 2 with a fulcrum portion of each lever 1 squeezing or compressing opposite sides of an upper area of spring body 3. Spring body 3 in turn flexes to such an extent where ledges of tabs 4 are pulled past the inner ends of respective arms 5*a*, 6*a*. With arms 5*a*, 6*a* unlatched, the weight of a garment residing on said arms 5*a*, 6*a* overcomes the force of return spring 8 permitting immediate collapse of arms 5*a*, 6*a* downwardly as depicted in FIG. 4. When the user releases her grip on levers 1, flexible spring body 3 recovers its normal shape.

When the garment falls off, or is removed from, the hanger arms 5*a*, 6*a* return springs 8 force arms 5*a*, 6*a* about pivots 11 past the spring body tabs 4, returning the hanger arms 5*a*, 6*a* to extended position, FIG. 3. For aesthetics as well as avoiding garment snags and dust accumulation, a cover housing 20 is provided about the key operating elements such as tab pivots 2, springs 11, spring body 3, and threaded connections of hook 7 stem and boss 18 interconnection.

Figure 5:
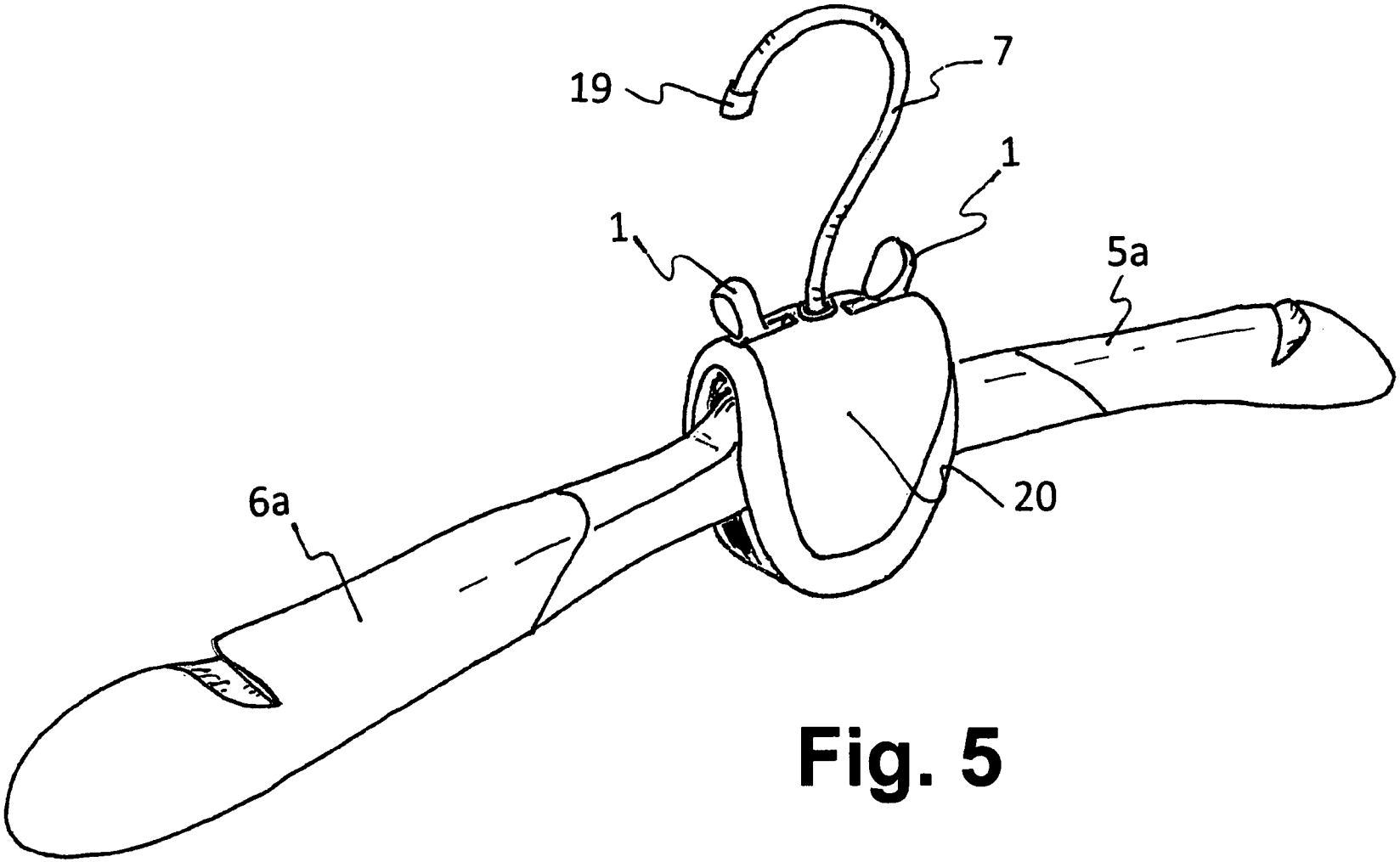
FIG. 5 is a perspective view of a hanger unit with arms in operative (extended) position with prominent spring body depressing tabs.
Figure 6:
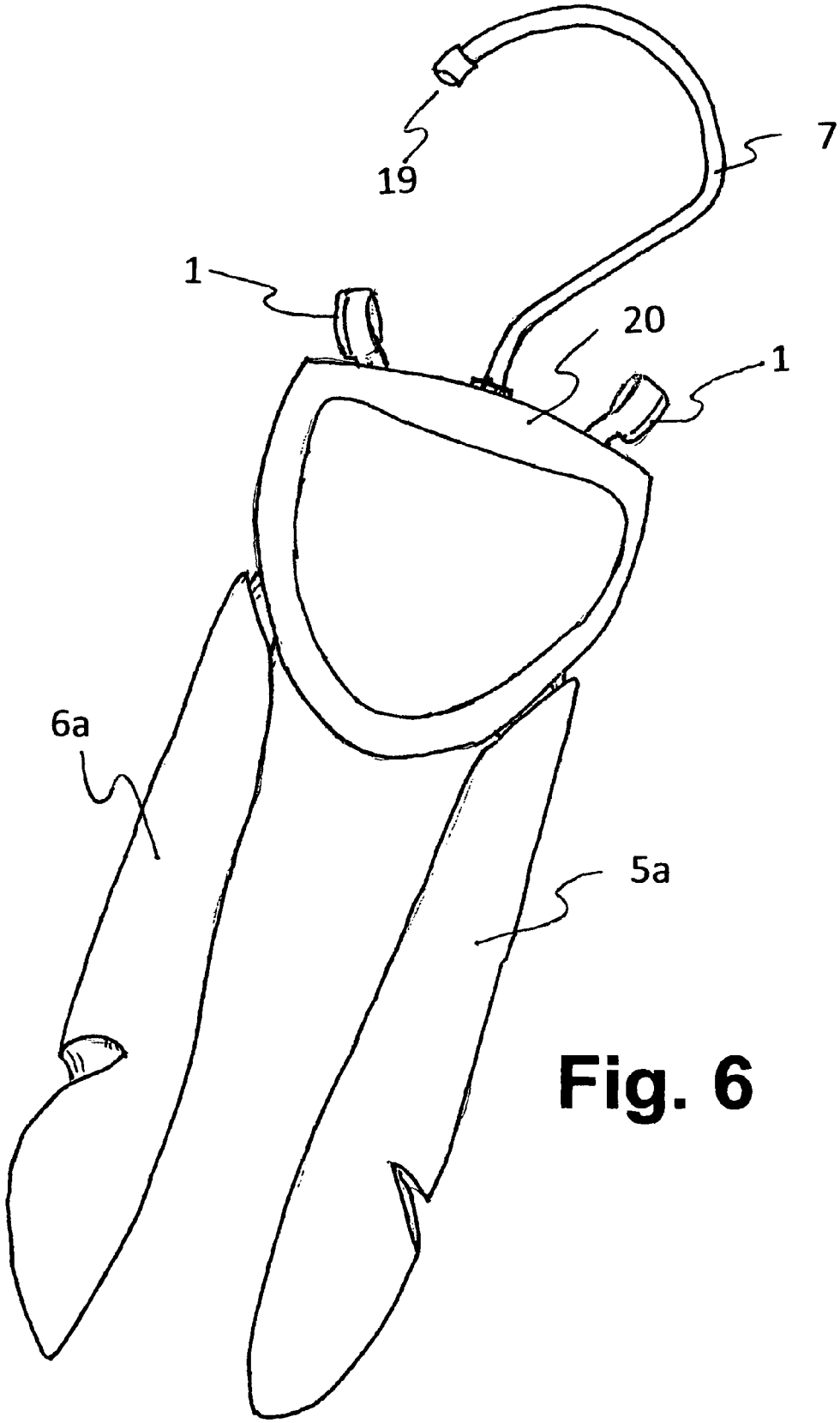
FIG. 6 is a perspective of the hanger of FIG. 5 illustrating the hanger arms in drop position following activation and release of said spring body depressing tabs.

FIG. 5 shows a hanger with its basic elements hook 7 and slightly slanted or inclined outstretched arms 5*a*, 6*a*. Also depicted are the tabs 1 discussed with respect to FIGS. 1-4. The "internal" mechanisms detail depicted in FIGS. 1-4 now are essentially hidden by cover housing 20 as illustrated in FIGS. 5 and 6. As discussed above, to adjust the slant or inclination of arms 5*a*, 6*a*, the user need only rotate the hook 7.

For example, clockwise rotation for one or a more turns will raise the inner, proximate ends of arms 5*a*, 6*a* resulting in an adjusted inclination downwardly toward their extreme, distal ends. A counterclockwise hook 7 turning will have the opposite effect as discussed hereabove. For quick release (at any inclination increment) tabs 1 can be immediately pressed by the user with only one hand, while the hanger hook remains engaged on its hanging rod (not shown). This quickly and easily drops the arms so that the garment slides off the arms 5*a*, 6*a*. Immediately upon being relieved of its garment weight, arms 5*a*, 6*a* return to said first position, modified by its most recently set adjusted inclination.

Finally, the following is a partial summary of advantages of this elegantly, easy to use invention: Varied pitch angles of the arms to best match the angle of the garment prevents fabric distortions (e.g., pucker, crease, out-dent) typically resulting from long term hanging; quick release of arms affords user the ability to remove the garment by permitting it to simply fall from hanger via the neckline; quick release further permits user's removal of the garment without first removing the hanger from the hanging rod; optional memory" capability permits hanger arms to return to their most recently set position; ability to turn the hanging hook so that the garment can hang parallel to the hanging rod. This further allows users to suspend the hanger on a door, chair back and tabletop or shelf edge; hanger's total collapse mode permits convenient storage in closets or suitcases.

The inventive device or system as depicted in its varied embodiments may be fabricated or formed in a variety of ways, shapes and from a variety of materials. The various parts may be machined, molded, or otherwise fabricated from plastic, recycled plastic, metal or wood or may be manufactured from a combination or composite of any suitable materials and processes. The choices of such materials and construction are clearly within the scope of the invention to be claimed. Upon careful review of the foregoing specification along with the accompanying drawings it will be evident that this invention is susceptible of modifications, combinations, and alterations in a number of ways which may differ from those set forth.

I claim:

1. An adjustable garment hanger, said hanger including:

a generally central hanging element for suspension of said hanger, said hanging element having a first end thereof configured for interconnection to an overhead suspension structure, and a second end of said hanging element comprising an elongated stem section;

a generally central housing supporting said hanging element for rotary movement therein, and further including a first pair of pivot pins;

said garment hanger further comprising first and second arms extended from inner to outer ends thereof and configured for supporting a garment, wherein each said arm is pivotally mounted on one of said pair of pivot pins so as to swing from a first outwardly extended garment holding position to a second downwardly dropped position for garment release;

a flexible spring body disposed in said central housing and including a boss threadably interconnected to said stem, and further including a pair of latching tabs each of which extends outwardly therefrom respectively toward said first and second arms;

said latching tabs configured with a generally downwardly facing ledge configured to normally restrict upward pivotal movement of said outwardly extended arms, thus maintaining said first and second arms in their first garment holding position;

whereby rotation of said hanging element in opposite directions will incrementally raise or lower said spring body, resulting in slight raising or lowering of said inner ends of said garment support arms to alter inclination of said arms about said first pins, and additional raising of said spring body serves to raise said latching tabs sufficiently to release said arms permitting them to fall to their second downwardly dropped position for garment release.

2. The adjustable garment hanger of claim 1 further including:

spring elements on said first set of pivot pins engaging said housing and biasing said arms to said first garment supporting position;

whereby said spring elements return said arms to their first position when a garment is released therefrom.

3. The adjustable garment hanger of claim 1 further defined by:

said generally central hanging element includes an upwardly extended hook configuration.

4. An adjustable garment hanger, said hanger including:

a generally central hanging element for suspension of said hanger, said hanging element having a first end thereof configured for interconnection to an overhead suspension structure, and a second end of said hanging element comprising an elongated stem section;

a generally central housing supporting said hanging element for rotary movement therein, and further including a first and second pair of pivot pins;

said garment hanger further comprising first and second arms extended from inner to outer ends thereof and configured for supporting a garment, wherein each said arm is pivotally mounted on one of said pair of pivot pins so as to swing from a first outwardly extended garment holding position to a second downwardly dropped position for garment release;

a flexible spring body disposed in said central housing and including a boss threadably interconnected to said stem elongated section, said flexible spring body further including a pair of latching tabs each of which extends outwardly therefrom respectively toward said first and second arms;

said latching tabs configured with a generally downwardly facing ledge configured to normally restrict upward pivotal movement of inner ends of said outwardly extended arms, thus maintaining said first and second arms in their first garment holding position;

a pair of levers pivotally mounted on said second set of pivot pins with a fulcrum portion of each of said levers engaged against an opposite side of an upper portion of said flexible spring body at a location upward from said latching tabs;

said rotation of said hanging element in opposite directions adjusts inclination of said arms upwardly or downwardly, and additional raising of said spring body serves to raise said latching tab ledges sufficiently to release said arms to fall to a collapsed position for garment release; moreover, squeezing pressure on said levers immediately compresses the spring body upper end causing immediate collapse of said arms.

5. The adjustable garment hanger of claim 4 further including:

spring elements on said first set of pivot pins engaging said housing and biasing said arms to said first garment supporting position;

whereby said spring elements return said arms to their first position when a garment is released therefrom.

6. The adjustable garment hanger of claim 4 further defined by:

said generally central hanging element includes an upwardly extended hook configuration.

* * * * *